US009039378B2

(12) United States Patent
Ulgen

(10) Patent No.: US 9,039,378 B2
(45) Date of Patent: May 26, 2015

(54) MARINE PROPELLER STRUCTURE

(76) Inventor: M. Nevres Ulgen, Istanbul (TR)

( * ) Notice: Subject to any disclaimer, the term of this patent is extended or adjusted under 35 U.S.C. 154(b) by 597 days.

(21) Appl. No.: 13/286,587

(22) Filed: Nov. 1, 2011

(65) Prior Publication Data

US 2012/0114489 A1 May 10, 2012

(30) Foreign Application Priority Data

Nov. 5, 2010 (TR) ..... a 2010 09193

(51) Int. Cl.
*B63H 1/20* (2006.01)
*B63H 1/26* (2006.01)

(52) U.S. Cl.
CPC ... *B63H 1/26* (2013.01); *B63H 1/20* (2013.01)

(58) Field of Classification Search
CPC ..... F04D 29/26; F04D 29/32; F04D 29/322; F04D 29/324; F04D 29/34; B63H 1/20; B63H 1/26
USPC ..... 416/219 A, 220 A, 248, 212 R, 245 A, 416/244 B; 440/49, 50
See application file for complete search history.

(56) References Cited

U.S. PATENT DOCUMENTS

| | | | | |
|---|---|---|---|---|
| 5,354,177 | A * | 10/1994 | Chang | 416/219 A |
| 6,176,680 | B1 * | 1/2001 | Ringblom et al. | 416/212 R |
| 7,056,092 | B2 * | 6/2006 | Stahl | 416/93 A |
| 7,357,686 | B2 * | 4/2008 | Lin et al. | 440/50 |
| 2005/0271509 | A1 * | 12/2005 | Chang et al. | 416/204 R |
| 2008/0166933 | A1 * | 7/2008 | Rosenkranz et al. | 440/50 |
| 2009/0155080 | A1 * | 6/2009 | Yu | 416/212 R |

* cited by examiner

*Primary Examiner* — Dwayne J White
*Assistant Examiner* — Brian P Wolcott
(74) *Attorney, Agent, or Firm* — Vidas, Arrett & Steinkraus

(57) ABSTRACT

A marine propeller has at least two blades each having a body, a vane and connection members that enable the blades to be fixed together. The blades are formed with a one-piece vane and the bodies are attached to one another and with the bodies form the central hub of the propeller that may be fitted on a ship's shaft after mounting.

23 Claims, 4 Drawing Sheets

MARINE PROPELLER STRUCTURE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a marine propeller structure.

In the state of the art, in order to produce a propeller firstly a model of the propeller is made and then the whole propeller is casted into this mold by preparing molds from this model. The propeller is roughly formed when it is removed from the mold. A homogeneous structure is not formed in the propeller removed from the mold and in order that the propeller is put into its final form it must be processed by machine or manually after the process of removal from the mold. Processing capacities of precision machines are variable. Therefore, difficulties are experienced in finding a device so as to process the propeller according to propeller sizes. Processing of overlapped blades is very difficult; this structure is bulky and very prone to error formation. For this reason, propellers removed from the mold have to be processed by hand machines in most cases. While the propeller is being processed, desired objectives cannot be achieved for 100 percent and this leads to loss of performance in propellers.

Due to all said disadvantages mentioned, production of propeller blades separately is possible as well. After the separated propeller blades produced are put into their final form by precision machines, they are assembled using various connection members (6) and additional fasteners and enabled to form the propeller.

Some applications in the state of the art are disclosed in the United States patent documents no. US2008/0166933A1 and no. US6537031B1, the Great Britain Patent document no. GB2328251A and the Chinese utility model no. CN2248162. In the said applications, propeller structures wherein the blades can be attached/detached to/from the propeller are disclosed. Propellers are formed by attaching the blades to a central hub by means of connection members (6) in the said propellers.

The Japanese patent document no. JP 1237068 (A), another application in the state of the art, discloses blades which form a propeller by means of a central hub again and production method of these blades and separate molding of these propeller blades. The blades removed from the mold are mounted to a central hub.

The Great Britain Patent document no. GB 2264983 discloses a propeller structure with no central hub. In the said propeller, the blades are fastened to an outer ring.

With the applications in the state of the art, problems arising from shapes, positions and size of overall dimensions of the propeller blades, in the molding process are eliminated. However, the blades are fastened to a body such as a central hub by means of connection members (6) due to disintegration risks originating from the centrifugal force created by the blades during rotation of the propeller. Maximum 4 blades can be attached to these hubs. In addition, surface area ratio regarding performance of the propeller in these propellers is close to 1/1 or less than this ratio.

BRIEF SUMMARY OF THE INVENTION

An objective of the present invention is to realize a propeller which can be produced simply and precisely.

Another objective of the invention is to realize a propeller having blades all characteristics of which are equal.

Yet another objective of the invention is to realize a propeller which has a segmented hub having one piece in each blade.

A further objective of the invention is to realize a propeller efficiency of which can be increased i.e. proportion of the blade surface area to the propeller area can be increased up to the ratio of 1:1.5.

An additional objective of the invention is to realize a propeller to which up to 6 blades can be attached and thus the vibration thereof is decreased by means of its surface area performance that can reach up to the ratio of 1:1.5, and which achieves less cavitation due to decrease of the blade pitch angle.

BRIEF DESCRIPTION OF THE SEVERAL VIEWS OF THE DRAWINGS

A propeller realized to fulfill the objectives of the present invention is illustrated in the accompanying figures, in which.

DETAILED DESCRIPTION OF THE INVENTION

Figure 1:
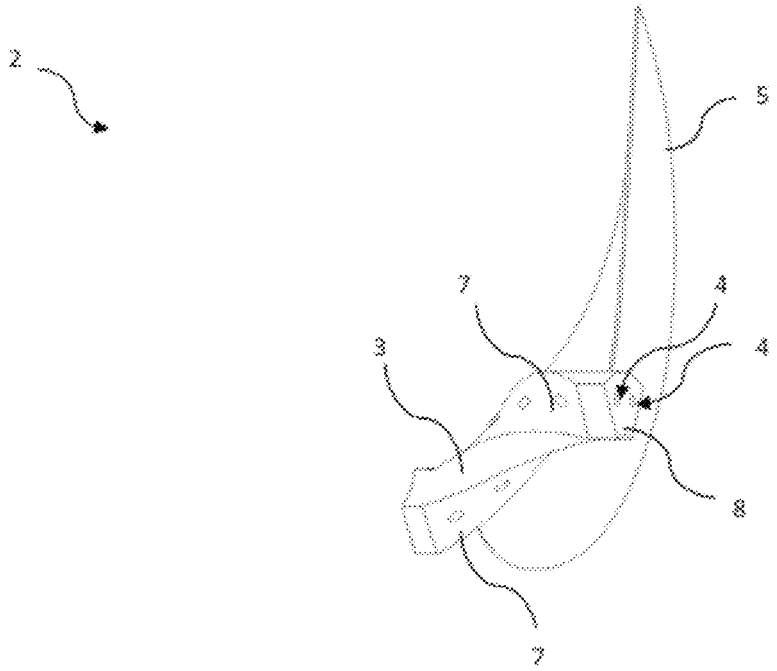
FIG. 1 is a perspective view of one of the blades composing the inventive propeller.
Figure 2:
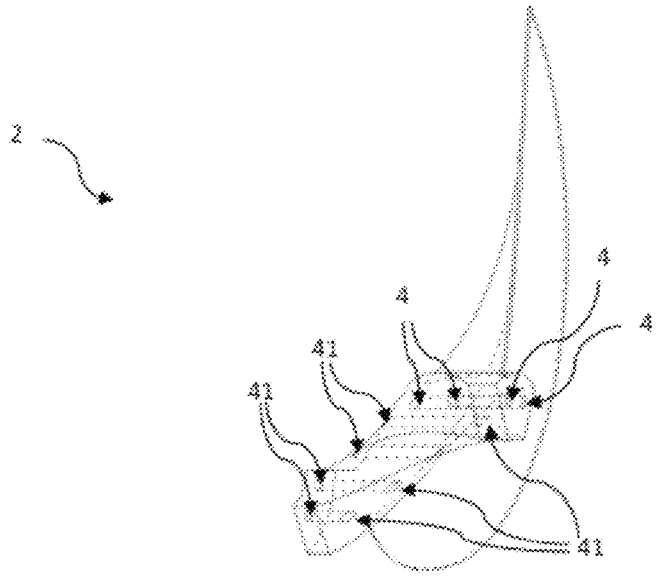
FIG. 2 is another perspective view of one of the blades composing the inventive propeller.
Figure 3:
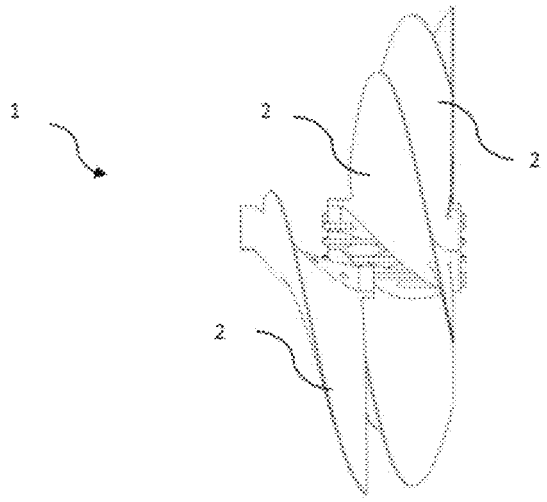
FIG. 3 is a side perspective view of the propeller at the mounting stage.
Figure 4:
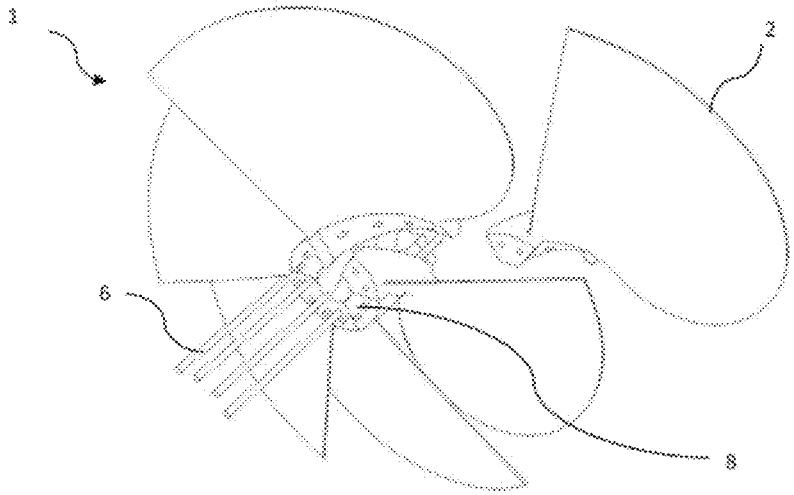
FIG. 4 is a front perspective view of the propeller at the mounting stage.
Figure 5:
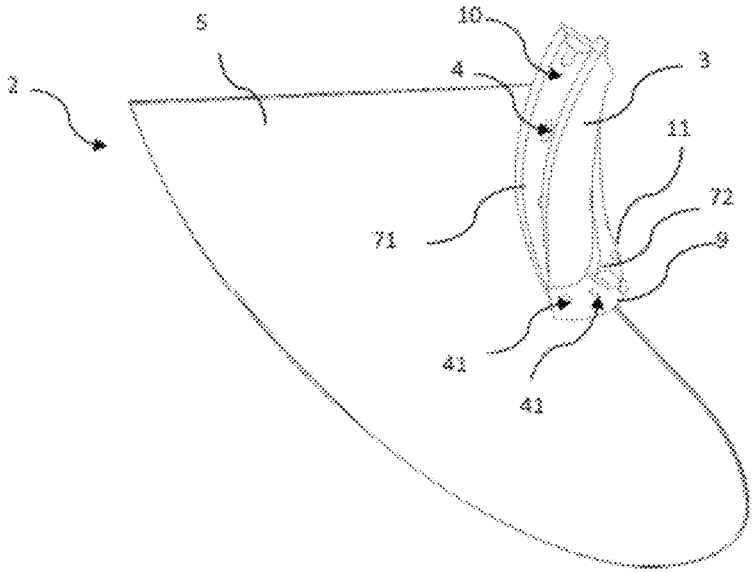
FIG. 5 is a perspective view of the blade composing the propeller in an embodiment of the invention, from one angle.
Figure 6:
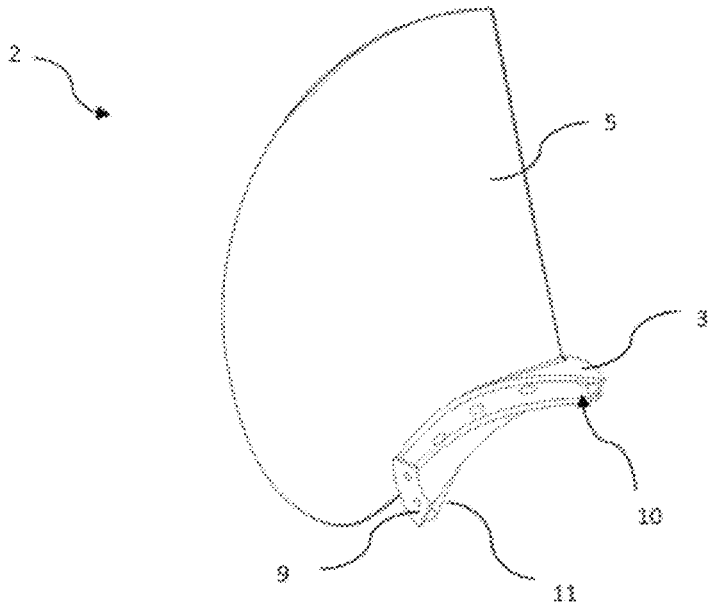
FIG. 6 is a perspective view of the blade composing the propeller in the embodiment of the invention in FIG. 5, from another angle.
Figure 7:
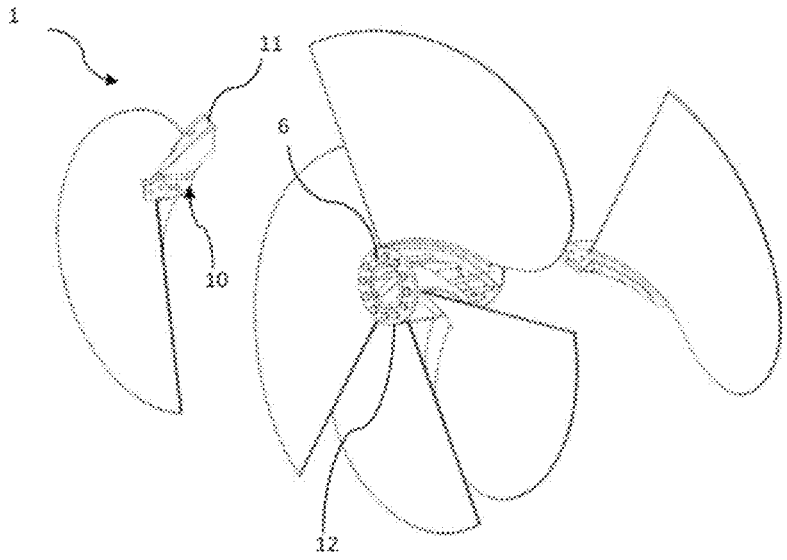
FIG. 7 is a perspective view of the propeller in the embodiment of the invention in FIG. 5 at the mounting stage.
Figure 8:
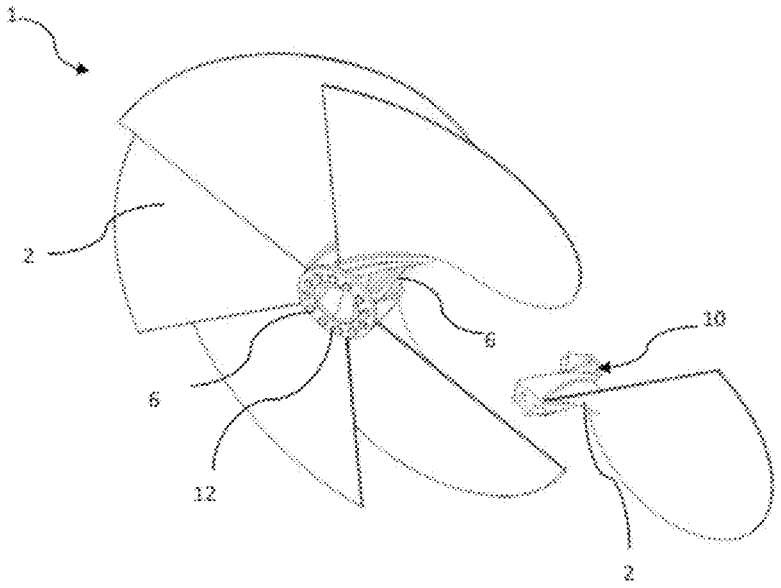
FIG. 8 is another perspective view of the propeller in the embodiment of the invention in FIG. 5 at the mounting stage.

While this invention may be embodied in many different forms, there are described in detail herein a specific preferred embodiment of the invention. This description is an exemplification of the principles of the invention and is not intended to limit the invention to the particular embodiment illustrated The components shown in the figures are numbered individually, where the numbers refer to the following:

1. Propeller
2. Blade
3. Body
4. Front face hole
5. Vane
6. Connection member
7. First side surface
8. Front surface
9. Back surface
10. Female groove
11. Male groove
12. Sleeve

41. Side surface hole

71. Second side surface

72. Third side surface

The inventive propeller (1) comprises at least three blades (2) each having one body (3) and one vane (5), and connection members (6) at least one for each blade (2) and enabling the blades (2) to be fixed.

The blades (2) are attached to one another by being fitted into one another at the mounting stage. After the mounting, bodies (3) which are the pieces of the blades (2) form the central hub of the propeller (1) which will be fitted into the ship's shaft.

The body (3) comprises two first side surfaces (7), a front surface (8) whereby the connection members (6) enter the body (3), a back surface (9) whereby the connection members (6) exit the body (3) front face hole 4 and side surface hole 41, are on the first side surface 7, front surface 8, and back surface 9 for the connection members to fit into.

The vane (5) and the body (3) composing the blade (2) are in one piece. The propeller (1) is formed when the blades (2) are attached to one another. The connection members are fitted into the front face hole 4 and the side surface hole 41 which are located on the bodies (3) of the blade (2) when the propeller (1) is formed in order that the propeller (1) does not break into pieces during rotation. The blades (2) are fixed to one another when the connection members (6) are fitted into the first face hole 4 and the side surface hole 41.

In a preferred embodiment of the invention, the connection members (6) are bar-shaped.

When the ship's shaft is passed through across the propeller (1), the body (3) is located on a side of the blade (2) facing the ship's shaft. The vane (5) is the surface of the blade (2) which extends outwards from the body (3). Front and back surfaces (8 and 9) of the bodies (3) of the blades (2), which will form the propeller (1), are planar. When the blades (2) are attached to one another the front and back surfaces (8, 9) form a circle ring on each center sections of the front and the back of the propeller (1). Whereas the first side surfaces (7) of the body (3) are spiral-shaped at desired pitch angle. The inner surfaces of the bodies (3) define a hollow conical cylinder in order that the ship's shaft is passed through when the blades (2) are attached to one another.

The body (3) extends along the inner surface of the vane (5) corresponding to the part into which the ship's shaft will fit across the propeller (1). For each connection member (6), there are at least two holes namely the front face hole 4 and the side surface hole 41 on the spiral body (3). While the two blades (2) are being fixed to one another each connection member (6) enters a front face hole 4 or a side surface hole 41 on a surface of the body (3) and leaves a front face hole 4 or a side surface hole 41 on the other surface thereof.

When a blade (2) is desired to be mounted to an adjacent blade (2) near it at the mounting stage of the blades (2) to one another; firstly the recesses of the blade (2), which arise from the pitch angle of the spiral form thereof on the first side surface (7) of its body (3), are attached to the protrusions thereof, which arise from the pitch angle of its same-shaped body (3) on the first side surface (7) thereof, such that they will complete each other. Thus, the bodies (3) of the blades (2) are engaged.

In a preferred embodiment of the invention, the propeller (1) comprises six blades (2). In this embodiment, the front and the back surfaces (8, 9) comprise two and the first side surfaces (7) comprise four holes (front face hole 4, side surface hole 41). After the blades (2) are mounted to one another by engaging the bodies (3), two connection members (6) are thrust into the body (3) vertically through the two front face holes 4 on the front surface (8) of the blade (2) the body (3) desired to be fixed. The connection members (6) fix the blades (2) to one another by both fitting into the front face holes 4 on the body (3) desired to be mounted and the side surface holes on the inner surface of the adjacent blade/s (2) where they are mounted. Thus, each body (3) of the blade (2) comprises two main connection members (6) that will connect itself to the other blades (2) and two connection members (6) belonging to the adjacent blades (2) which will connect the adjacent blades (2) to itself such that one connection member will come from each adjacent.

The propeller (1) also comprises at least two sleeves (12), one at the front and one at the back side, for the connection members (6) to be fixed. Each sleeve (12) is closed over the front and back surfaces (8 and 9) which are the outer surfaces of the circle rings that are formed at the center sections of the front and the back of the blades (2) mounting of which is completed. The connection members (6) are fixed by being fitted into the sleeves (12) by means of nuts.

In an embodiment of the invention, the body (3) comprises at least one female groove (10) and/or at least one male groove (11) on its first side surfaces (7). This male groove (11) and the female grooves (10) are formed such that while the blades (2) are being mounted to one another, a male groove (11) on the first side surface (7) of a body (3) will correspond to the female groove (10) on the first side surface (7) of the adjacent blade whereto it will be attached. In this embodiment, while the blades (2) are being mounted the bodies (3) provide both fixing by means of their recesses and protrusions of the spiral forms thereof and an interlocking by means of the male groove (11) and the female grooves (10) located on the first side surfaces (7). In this embodiment, lastly a second interlocking is provided by fitting the connection members (6) into the front face holes 4 and side surface holes 41. This embodiment is used in large-diameter propellers (1) disintegration risk of which is more, for example during rotation, in cases where the force of the load exerted on the propeller (1) during rotation is big.

In an alternative of this embodiment of the invention, there is at least one female groove (10) on one second side surface (71) of the body (3) and at least one male groove (11) on another third side surface (72) thereof. In an example of this alternative, the female groove (10) is in the form of a channel that will across the body (3) on a second side surface (71) of the body (3). In this example, the male groove (11) on the third side surface (72) of the body (3) is in the form of a protrusion that will across the third side surface (72).

Shape of the blades (2) of the inventive propeller (1) can be produced so as to provide high efficiency; the surface area ratio can be increased up to 1/1.5.

The fact that there is not a central hub separated form the blades (2) and the whole of the propeller (1) is only formed of blades (2) facilitated the production process and enabled the propeller (1) blades (2) to be more precise. Each blade (2) which forms the propeller (1) produced and comprises a hub piece are equal at the same weight, thickness and geometry with excellent precision. Surfaces of the propeller (1) blades (2) are more smooth and balances of the blades (2) are equal.

It is possible to develop various embodiments of the inventive marine propeller (1). The invention can not be limited to the examples described herein and it is essentially according to the claims.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A propeller (1) comprising:

at least three blades (2) each having a body (3) of a spiral form such that each body (3) when mounted to one another form a propeller hub;

each blade including a vane (5) extending outwardly from each body (3), wherein each body (3) comprises two opposite spiral first side surfaces (7) and a front surface and a back surface;

each blade being a single piece with the vane and body;

wherein each body (3) comprises at least two connection holes passing parallel to an axis of rotation of the propeller and passing through the front surface, first side surface and back surface of the body;

each blade body being positioned with another of said blade bodies against the spiral first side surfaces such that the blade bodies so positioned form a segmented hub; and a plurality of connection members (6) each passing through a connection hole through the front surface, first side surface and back surface of said bodies such that the segmented hub is secured together.

2. The propeller according to claim 1, wherein each body (3) comprises a male groove (11) on one first side surface (7) and a female groove (10) on the opposite first side surface (7).

3. The propeller according to claim 1, wherein each body (3) comprises an inner surface having a form such that when all bodies (3) are mounted to one another, said inner surface has a conical cylindrical form.

4. The propeller according to claim 1, wherein each body (3) comprises a front surface (8) and a back surface (9), each body having two holes for receiving connection members (6).

5. The propeller according to claim 1, wherein the propeller has 6 blades.

6. The propeller according to claim 1, further comprising a plurality of front face holes and a plurality of side surface holes, wherein connection members (6) attach the blades (2) to one another by being fitted into the front face holes and the side surface holes.

7. The propeller (1) according to claim 1, wherein said connection members (6) are bar-shaped.

8. The propeller (1) according to claim 3, wherein bodies (3) which are located on a side of the blade (2) facing a shaft of a ship to which said propeller would be attached is passed through across the propeller (1) and extend along the inner surface of a vane (5).

9. The propeller (1) according to claim 8, wherein said bodies (3) when assembled define a hollow conical cylinder.

10. The propeller (1) according to claim 5, wherein said body (3) has front and back surfaces (8, 9) in a planar structure.

11. The propeller (1) according to claim 10, wherein said propeller includes a front and back and center section, wherein front and back surfaces (8, 9) form a circle ring on each center section of the front and the back of the propeller (1) when the blades (2) are attached to one another.

12. The propeller (1) according to claim 1, wherein each said body (3) has first side surfaces (7) in a spiral form at a desired pitch angle.

13. The propeller (1) according to claim 5, wherein each body (3) includes four side surface holes at each first side surface (7) thereof.

14. The propeller (1) according to claim 1, each body (3) comprising two front face holes and two side surface holes for engagement to each connection member (6).

15. The propeller (1) according to claim 1, wherein each said connection member (6) affixes two blades (2) to one another by entering a front face hole or a side surface hole on a surface of the body (3) and leaving a front face hole or a side surface hole on the other surface thereof.

16. The propeller (1) according to claim 12, wherein blade (2) recesses arising from the pitch angle of the first side surface (7) are mounted to an adjacent blade (2).

17. The propeller (1) according to claim 10 further comprising a plurality of front face holes and a plurality of side surface holes, wherein the blade (2) is fixed to adjacent blades (2) with the connection members (6) being thrust into the body (3) vertically through the front face holes (4) on the front surface (8) of the body (3) thereof.

18. The propeller (1) according to claim 5, further comprising a plurality of front face holes and a plurality of side surface holes, wherein connection members (6) fix the blades (2) to one another both by fitting into the front face holes (4) on the body (3) of the blade (2) mounted and into the side surface holes (41) on an inner surface of an adjacent blade (2) where said blade (2) is mounted.

19. The propeller (1) according to claim 4, wherein two sleeves (12) are closed over the front and back surfaces (8, 9) of the bodies (3).

20. The propeller (1) according to claim 1, wherein the body (3) includes at least one female groove (10), or at least one male groove (11), or at least one female groove and at least one male groove on the first side surfaces (7) thereof.

21. The propeller (1) according to claim 20, wherein said male grooves (11) and female grooves (10) comprise a male groove (11) on the first side surface (7) of a body (3) corresponding to a female groove (10) on the first side surface (7) of the adjacent blade whereto it will be attached.

22. The propeller (21) according to claim 21, wherein said body (3) comprises at least one female groove (10) on one second side surface (71) and at least one male groove (11) on one third side surface (72).

23. The propeller (1) according to claim 22, wherein the body (3) comprises at least one channel-shaped female groove (10) crossing the body (3) on one second side surface (71), and at least one protrusion-shaped male groove (11) crosses one third side surface (72) of the body (3).

* * * * *